US011879647B2

(12) United States Patent
Zemborain et al.

(10) Patent No.: US 11,879,647 B2
(45) Date of Patent: Jan. 23, 2024

(54) PORTABLE AIR CONDITIONING UNIT WINDOW INSTALLATION SYSTEM

(71) Applicant: Electrolux Appliances Aktiebolag, Stockholm (SE)

(72) Inventors: Pedro Zemborain, Stockholm (SE); Zack Palomäki, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 100 days.

(21) Appl. No.: 17/558,962

(22) Filed: Dec. 22, 2021

(65) Prior Publication Data

US 2023/0194105 A1 Jun. 22, 2023

(51) Int. Cl.
*F24F 1/031* (2019.01)
*F24F 1/028* (2019.01)
*F24F 1/04* (2011.01)

(52) U.S. Cl.
CPC ..... *F24F 1/031* (2019.02); *F24F 1/028* (2019.02); *F24F 1/04* (2013.01); *F24F 2221/12* (2013.01); *F24F 2221/20* (2013.01)

(58) Field of Classification Search
CPC ..... F24F 1/031; F24F 1/028; F24F 2221/20; F24F 1/04; F24F 2221/12; F24F 2221/125; F16B 2/12
See application file for complete search history.

(56) References Cited

U.S. PATENT DOCUMENTS

| | | | |
|---|---|---|---|
| 399,491 | A | 3/1889 | Bukawietis |
| 1,954,017 | A | 4/1934 | Manning |
| 2,234,753 | A | 3/1941 | Frazer |
| 2,268,451 | A | 12/1941 | Hull |
| 2,320,436 | A | 6/1943 | Hull |
| 2,436,713 | A | 2/1948 | Cody |
| 2,568,968 | A | 9/1951 | Perrin |
| 2,608,148 | A | 8/1952 | Shapiro |
| 2,708,833 | A | 5/1955 | Nigro |
| 2,814,244 | A | 11/1957 | Hord |
| 2,818,793 | A | 1/1958 | Hord |
| 2,925,026 | A | 2/1960 | Schuster et al. |
| 2,935,284 | A | 5/1960 | Reeves |
| 3,030,873 | A | 4/1962 | Metcalfe |
| 3,134,319 | A | 5/1964 | Marsteller |
| 3,476,033 | A | 11/1969 | Appel |
| 3,481,264 | A | 12/1969 | Ulich |

(Continued)

FOREIGN PATENT DOCUMENTS

| | | | |
|---|---|---|---|
| CN | 2190590 | Y | 3/1995 |
| CN | 2413205 | Y | 1/2001 |

(Continued)

OTHER PUBLICATIONS

EP2602420A2 Translation (Year: 2013).*

(Continued)

*Primary Examiner* — Schyler S Sanks

(74) *Attorney, Agent, or Firm* — Bradley Arant Boult Cummings LLP

(57) ABSTRACT

A portable air conditioner unit window installation system having a closure plate, a vent opening through the closure plate, a clamp fixture located adjacent to the vent opening in a longitudinal direction of the closure plate, and a clamp movably mounted to the clamp fixture.

25 Claims, 9 Drawing Sheets

(56) References Cited

U.S. PATENT DOCUMENTS

| | | | | |
|---|---|---|---|---|
| 3,491,549 | A | 1/1970 | Oglesby | |
| 3,552,470 | A | 1/1971 | Metcalfe | |
| 3,554,476 | A | 1/1971 | Gaylor, Jr. | |
| 3,698,208 | A | 10/1972 | Navara | |
| 3,698,308 | A | 10/1972 | Navaro | |
| 3,911,803 | A | 10/1975 | Kong et al. | |
| 4,086,886 | A | 5/1978 | Edmaier et al. | |
| 4,152,844 | A | 5/1979 | Materniak et al. | |
| 4,203,302 | A | 5/1980 | Lapeyre | |
| 4,334,461 | A | 6/1982 | Ferguson et al. | |
| 5,027,614 | A | 7/1991 | Mori et al. | |
| 5,167,131 | A | 12/1992 | Karkhanis | |
| 5,290,343 | A | 3/1994 | Morita et al. | |
| 5,365,992 | A | 11/1994 | Swain et al. | |
| 5,582,025 | A | 12/1996 | Dubin et al. | |
| 5,823,289 | A | 10/1998 | Csomos | |
| 5,979,172 | A | 11/1999 | Teller | |
| 5,979,533 | A | 11/1999 | Dupuie | |
| 6,173,930 | B1 | 1/2001 | Arbucci | |
| 6,257,013 | B1 | 7/2001 | Murray et al. | |
| 6,416,570 | B2 | 7/2002 | Goto et al. | |
| 6,568,201 | B1 | 5/2003 | Cur et al. | |
| 6,767,278 | B1 | 7/2004 | Peterson | |
| 6,983,621 | B2 | 1/2006 | Cur et al. | |
| 7,121,105 | B1 | 10/2006 | Rais | |
| 7,296,424 | B2 | 11/2007 | Thompson | |
| 7,332,019 | B2 | 2/2008 | Bias et al. | |
| 7,350,759 | B1 | 4/2008 | Gray | |
| 7,601,204 | B2 | 10/2009 | Woodruff et al. | |
| 7,854,141 | B1 | 10/2010 | Breen | |
| 7,896,957 | B2 | 3/2011 | Zhao et al. | |
| 7,975,441 | B2 | 7/2011 | McCarriston | |
| 8,091,844 | B1 | 1/2012 | Bragg | |
| 8,104,240 | B2 | 1/2012 | McCarriston | |
| 8,578,728 | B2 | 11/2013 | Cho et al. | |
| 8,584,998 | B1 | 11/2013 | Peterson | |
| 9,163,854 | B2 | 10/2015 | Arbuccci | |
| 9,179,794 | B2 | 11/2015 | Darby | |
| 9,303,895 | B1 | 4/2016 | Grant | |
| 9,447,916 | B2 | 9/2016 | Darby et al. | |
| D782,289 | S | 3/2017 | Darby et al. | |
| 9,605,870 | B2 | 3/2017 | Darby et al. | |
| 9,909,712 | B1 | 3/2018 | Parby | |
| 9,938,044 | B2 | 4/2018 | Gamboa | |
| 9,982,909 | B1 | 5/2018 | Perez et al. | |
| 10,077,918 | B2 | 9/2018 | Darby et al. | |
| 10,104,964 | B2 | 10/2018 | Darby | |
| 10,104,965 | B1 | 10/2018 | Miller | |
| 10,203,130 | B2 | 2/2019 | Gardikis et al. | |
| 10,203,180 | B2 | 2/2019 | Miller et al. | |
| 10,295,221 | B2 | 5/2019 | Zhang et al. | |
| 10,359,212 | B2 | 7/2019 | Darby | |
| 10,401,043 | B2 | 9/2019 | Li | |
| 10,408,494 | B2 | 9/2019 | Darby | |
| 10,520,206 | B2 | 12/2019 | Xu et al. | |
| 10,712,058 | B2 | 7/2020 | Itakura et al. | |
| 10,775,054 | B2 | 9/2020 | Bradford et al. | |
| 10,900,689 | B2 | 1/2021 | Weiner | |
| 2001/0032545 | A1 | 10/2001 | Goto et al. | |
| 2003/0097854 | A1 | 5/2003 | Cur et al. | |
| 2003/0110789 | A1 | 6/2003 | Cur et al. | |
| 2005/0028545 | A1 | 2/2005 | Herbert | |
| 2006/0021359 | A1 | 2/2006 | Hur et al. | |
| 2006/0223434 | A1* | 10/2006 | Barker | E06B 7/10 454/203 |
| 2007/0023592 | A1 | 2/2007 | Makaso | |
| 2007/0068185 | A1 | 3/2007 | Thompson | |
| 2007/0137237 | A1 | 6/2007 | Rais | |
| 2008/0053309 | A1 | 3/2008 | Woodruff et al. | |
| 2008/0104989 | A1 | 5/2008 | Movshovitz | |
| 2010/0077924 | A1 | 4/2010 | Zhao et al. | |
| 2010/0197214 | A1 | 8/2010 | Geremia, Sr. et al. | |
| 2010/0229585 | A1 | 9/2010 | Bradford et al. | |
| 2010/0326103 | A1 | 12/2010 | Stamm et al. | |
| 2012/0137499 | A1 | 6/2012 | Agnihotri | |
| 2012/0274188 | A1 | 11/2012 | Shiborino | |
| 2013/0104581 | A1 | 5/2013 | Consoli | |
| 2013/0153744 | A1 | 6/2013 | Jin et al. | |
| 2013/0327509 | A1 | 12/2013 | Michitsuji | |
| 2014/0020421 | A1 | 1/2014 | Gallo | |
| 2014/0076506 | A1 | 3/2014 | Olivas | |
| 2014/0090334 | A1 | 4/2014 | Darby et al. | |
| 2014/0311063 | A1 | 10/2014 | McIntyre | |
| 2015/0034784 | A1 | 2/2015 | Darby | |
| 2015/0097096 | A1 | 4/2015 | Arbucci | |
| 2015/0211802 | A1 | 7/2015 | Yokozeki et al. | |
| 2015/0354838 | A1 | 12/2015 | Cur et al. | |
| 2016/0033166 | A1 | 2/2016 | Herbert | |
| 2016/0058189 | A1 | 3/2016 | Darby | |
| 2016/0097547 | A1 | 4/2016 | Selg et al. | |
| 2016/0298872 | A1 | 10/2016 | Darby et al. | |
| 2017/0153041 | A1 | 6/2017 | Darby et al. | |
| 2017/0159948 | A1 | 6/2017 | Darby | |
| 2017/0191763 | A1 | 7/2017 | Xu et al. | |
| 2017/0254557 | A1* | 9/2017 | Chiu | F24F 13/0218 |
| 2017/0284683 | A1 | 10/2017 | Gallo et al. | |
| 2017/0297768 | A1 | 10/2017 | Gamboa | |
| 2017/0328596 | A1 | 11/2017 | Darby | |
| 2018/0023842 | A1 | 1/2018 | Gardikis, Sr. et al. | |
| 2018/0180305 | A1 | 6/2018 | Zhang | |
| 2019/0056143 | A1 | 2/2019 | Zhang | |
| 2019/0063760 | A1 | 2/2019 | Li | |
| 2019/0212028 | A1* | 7/2019 | Zemborain | F24F 13/18 |
| 2019/0212032 | A1 | 7/2019 | Galvan | |
| 2020/0124296 | A1 | 4/2020 | Baumann et al. | |
| 2020/0248911 | A1 | 8/2020 | Lei et al. | |
| 2020/0333021 | A1 | 10/2020 | Galvan | |
| 2020/0363075 | A1 | 11/2020 | Bradford et al. | |
| 2021/0010688 | A1 | 1/2021 | Biasotti et al. | |
| 2021/0078118 | A1 | 3/2021 | Li et al. | |
| 2021/0088251 | A1 | 3/2021 | Martinez Galvan et al. | |
| 2021/0180828 | A1 | 6/2021 | Xing et al. | |
| 2021/0356146 | A1 | 11/2021 | Zhang et al. | |
| 2021/0404749 | A1 | 12/2021 | Wexler et al. | |

FOREIGN PATENT DOCUMENTS

| | | | | |
|---|---|---|---|---|
| CN | 1338593 | A | 3/2002 | |
| CN | 1445491 | A | 10/2003 | |
| CN | 1595005 | A | 3/2005 | |
| CN | 1727764 | A | 2/2006 | |
| CN | 201104001 | Y | 8/2008 | |
| CN | 201249077 | Y | 6/2009 | |
| CN | 101523120 | A | 9/2009 | |
| CN | 201589348 | U | 9/2010 | |
| CN | 103471223 | A | 12/2013 | |
| CN | 203379993 | U | 1/2014 | |
| CN | 203501389 | U | 3/2014 | |
| CN | 203518172 | U | 4/2014 | |
| CN | 104061632 | A | 9/2014 | |
| CN | 203980467 | U | 12/2014 | |
| CN | 204141751 | U | 2/2015 | |
| CN | 204153874 | U | 2/2015 | |
| CN | 204202053 | U | 3/2015 | |
| CN | 204491248 | U | 7/2015 | |
| CN | 105202831 | A | 12/2015 | |
| CN | 205037425 | U | 2/2016 | |
| CN | 205137735 | U | 4/2016 | |
| CN | 106152315 | A | 11/2016 | |
| CN | 106949559 | A | 7/2017 | |
| CN | 206369283 | U | 8/2017 | |
| CN | 107980091 | A | 5/2018 | |
| CN | 207963242 | U | 10/2018 | |
| CN | 108800686 | A | 11/2018 | |
| CN | 109073269 | A | 12/2018 | |
| CN | 109631434 | A | 4/2019 | |
| DE | 4230604 | A1 | 3/1994 | |
| EP | 0756140 | A2 | 1/1997 | |
| EP | 1248049 | A2 | 10/2002 | |
| EP | 1956307 | A1 | 8/2008 | |
| EP | 2063192 | A1 | 5/2009 | |
| EP | 2602420 | A2 * | 6/2013 | E06B 7/28 |
| EP | 3276279 | A1 | 1/2018 | |
| FR | 755472 | A | 11/1933 | |

(56) References Cited

FOREIGN PATENT DOCUMENTS

| | | | |
|---|---|---|---|
| GB | 212669 | | 3/1924 |
| GB | 2126695 | A | 3/1984 |
| JP | 54105838 | A | 8/1979 |
| JP | 07248128 | A | 9/1995 |
| JP | 08226745 | A | 9/1996 |
| JP | 08285413 | A | 11/1996 |
| JP | 2000002474 | A | 1/2000 |
| JP | 2001239121 | A | 9/2001 |
| JP | 2002357338 | A | 12/2002 |
| JP | 2009144984 | A | 7/2009 |
| JP | 2012132640 | A | 7/2012 |
| JP | 2018123717 | A | 8/2019 |
| KR | 20050117664 | A | 12/2005 |
| KR | 20070077917 | A | 7/2007 |
| KR | 20160086637 | A | 7/2016 |
| KR | 20160111687 | A | 9/2016 |
| KR | 102187381 | B1 | 12/2020 |
| KR | 20210077328 | A | 6/2021 |
| WO | 8800676 | A1 | 1/1988 |
| WO | 0190657 | A1 | 11/2001 |
| WO | 2005054751 | A2 | 6/2005 |
| WO | 2005116530 | A1 | 12/2005 |
| WO | 2009052372 | A2 | 4/2009 |
| WO | 2011079371 | A1 | 7/2011 |
| WO | 2012056164 | A1 | 5/2012 |
| WO | 2014188526 | A1 | 11/2014 |
| WO | 2014206846 | A1 | 12/2014 |
| WO | 2015098157 | A1 | 7/2015 |
| WO | 2015115929 | A1 | 8/2015 |
| WO | 2017001914 | A1 | 1/2017 |
| WO | 2017045909 | A1 | 3/2017 |
| WO | 2017045934 | A1 | 3/2017 |
| WO | 2017075658 | A1 | 5/2017 |
| WO | 2017194092 | A1 | 11/2017 |
| WO | 2018090114 | A1 | 5/2018 |
| WO | 2020038239 | A1 | 2/2020 |

OTHER PUBLICATIONS

Chinese Office Action for Chinese Application No. 201680028498.X, dated Sep. 4, 2019, with translation, 15 pages.
Chinese Office Action for Chinese Application No. 201680085261.5, dated Apr. 14, 2020, 11 pages.
Chinese Office Action for Chinese Application No. 201680085261.5, dated Dec. 11, 2020, with translation, 28 pages.
International Search Report and Written Opinion for International Application No. PCT/IB2016/000949, dated Nov. 2, 2016, 9 pages.
International Search Report and Written Opinion for International Application No. PCT/EP2016/060396, dated Jan. 24, 2017, 9 pages.
International Search Report and Written Opinion for International Application No. PCT/EP2016/070382, dated Dec. 1, 2016, 14 pages.
International Search Report and Written Opinion for International Application No. PCT/EP2016/070702, dated Dec. 9, 2016, 9 pages.
Non Final Office Action for U.S. Appl. No. 16/771,107, dated Feb. 8, 2022, 11 pages.
European Communication pursuant to Article 94(3) for European Application No. 16 721 184.6, dated Oct. 7, 2020, 7 pages.
Notice of Allowance for U.S. Appl. No. 16/771,107, dated Jul. 20, 2022, 9 pages.
Non Final Office Action for U.S. Appl. No. 16/771,111, dated Sep. 8, 2022, 17 pages.
Final Office Action for U.S. Appl. No. 16/771,111, dated Apr. 19, 2022, 30 pages.
Chinese Office Action for Chinese Application No. 2016800860880, dated Jan. 26, 2021, with translation, 18 pages.
International Search Report and Written Opinion for International Application No. PCT/EP2016/062022, dated Jan. 23, 2017—9 pages 1.
Chinese Office Action for Chinese Application No. 2016800860880, dated May 7, 2020, 8 pages.
Non Final Office Action for U.S. Appl. No. 16/771,111, dated Dec. 21, 2021, 41 pages.
Non Final Office Action for U.S. Appl. No. 16/771,456, dated Nov. 10, 2021, 39 pages.
"Evidence for Common Knowledge," 2014, 6 pages.
Chinese Office Action for Chinese Application No. 201780097448.1, dated Jun. 29, 2021, with translation, 14 pages.
Chinese Office Action for Chinese Application No. 201780097456.6, dated Jan. 6, 2021, with translation, 19 pages.
Chinese Office Action with Search Report for Application No. 201780097448.1, dated Jan. 12, 2021, 8 pages.
Chinese Office Action with Search Report for Chinese Application No. 201780097449.6, dated Jan. 12, 2021, 8 pages.
International Preliminary Report on Patentability for International Application No. PCT/EP2017/082610, dated Jun. 16, 2020, 5 pages.
International Search Report and Written Opinion for International Application PCT/EP2017/082610, dated Aug. 21, 2018, 7 pages.
International Preliminary Report on Patentability for International Application No. PCT/EP2017/082615, dated Jun. 16, 2020, 7 pages.
International Preliminary Report on Patentability for International Application No. PCT/EP2017/082611, dated Jun. 16, 2020, 7 pages. 2020.
International Search Report and Written Opinion for International Application PCT/EP2017/082615, dated Aug. 9, 10 pages.
International Search Report and Written Opinion for International Application PCT/EP2017/082611, dated Aug. 9, 2018, 10 pages.
Non Final Office Action for U.S. Appl. No. 16/771,111, dated Mar. 10, 2023, 13 pages.
Chinese Office Action for Chinese Application No. 201980102818.5, dated Sep. 1, 2023, 8 pages.

* cited by examiner

PORTABLE AIR CONDITIONING UNIT WINDOW INSTALLATION SYSTEM

TECHNICAL FIELD

This application is directed to systems for attaching a hose of a portable air conditioning unit to a window.

BACKGROUND

Air conditioning units are in common use to provide cooling to homes and other buildings. In some cases, the air conditioning unit is a permanent installation within the building, including airflow ducts and ventilation openings that pass through floors and walls to convey conditioned air. In other cases, the air conditioning unit is a non-permanent system that is installed into a pre-existing building, and operates separately from integrated airflow ducts and openings (if any) that are already present in the building. There are several varieties of non-permanent air conditioning units, including so-called "window units" that have their operating parts (compressor, evaporator, etc.) contained in one or more housings that are installed to extend through a window opening, and so-called "portable units" that have their operating parts in a housing that is placed inside a room.

In the case of portable units, the housing typically includes a closed fluid circuit having a condenser, throttle (thermal expansion valve or capillary tube), evaporator, and compressor. The compressor receives cool gaseous refrigerant, pressurizes and heats the refrigerant, and conveys the heated refrigerant to the condenser. The heated refrigerant passes through the condenser, where a fan blows air over the condenser to remove heat. The refrigerant then passes through the throttle, which lowers the refrigerant pressure and temperature. The cooled refrigerant then passes through the evaporator, and another fan blows air over the evaporator to evacuate cooled air into the room being conditioned. The refrigerant then passes back to the compressor to continue the cycle.

In order for the air conditioning unit to cool the room, the heated air from the condenser must be evacuated from the room. This is typically done by connecting a flexible hot air duct to the outlet of the condenser fan to convey the heated air out of the room, commonly through a window opening. An installation system is usually used to connect the hot air duct to the window opening, and seal the remainder of the opening to prevent outside air from entering the room. Thus, the installation system should provide a proper seal at the window, and also resist accidental detachment.

A typical installation system is provided as a kit having a closure plate that is secured to the window sash and/or frame using clamps, screws, or other fasteners. The closure plate has an opening to which the hot air duct connects, and is otherwise solid to prevent air passage. The closure plate also may be expandable to fit window openings of different widths.

While window installation systems are commonly available, it has been found that they can suffer from various problems, such as complexity, difficulty with installation, poor sealing, poor holding ability (i.e., easily detached by accident), and so on. Thus, there continues to be a need to advance the art of portable air conditioner window installation systems.

This description of the background is provided to assist with an understanding of the following explanations of exemplary embodiments, and is not an admission that any or all of this background information is necessarily prior art.

SUMMARY

In a first aspect, there is provided a window installation system for a portable air conditioner unit, the window installation system comprising: a closure plate extending in a longitudinal direction between a first longitudinal end and a second longitudinal end, and in a transverse direction, perpendicular to the longitudinal direction, between a first transverse end and a second transverse end; a vent opening extending through the closure plate between a first side of the closure plate and a second side of the closure plate, at a longitudinal location between the first longitudinal end and the second longitudinal end; a clamp fixture located adjacent to the vent opening at the longitudinal location; and a clamp movably mounted to the clamp fixture and having a clamp surface facing the first side of the closure plate, wherein the clamp is movable relative to the clamp fixture between a first clamp position in which the clamp surface is a first distance from the first side of the closure plate in a depth direction that is perpendicular to the longitudinal direction and the transverse direction, and a second clamp position in which the clamp surface is a second distance from the first side of the closure plate in the depth direction, the second distance being less than the first distance.

In some embodiments, the first transverse end is configured to seal against a window sash, and the second transverse end is configured to seal against a window frame.

In some embodiments, the first longitudinal end is configured to seal against a first window frame rail, and the second longitudinal end is configured to seal against a second window frame rail facing the first window frame rail.

In some embodiments, the window installation system does not include any additional clamp or clamps.

In some embodiments, the clamp is movable along the clamp fixture on a linear path between the first clamp position and the second clamp position, the linear path extending parallel to the depth direction.

In some embodiments, the clamp fixture has a first portion fixed to the closure plate and a second portion selectively mountable to the first portion, and wherein the clamp is movably mounted to the second portion.

In some embodiments, the first portion comprises a first fixed portion located along the transverse direction between the vent opening and the first transverse end of closure plate, and a second fixed portion located along the transverse direction between the vent opening and the second transverse end of the closure plate, wherein the second portion is selectively and alternately securable to one of the first fixed portion and the second fixed portion.

In some embodiments, the at least one first portion comprises a first rail member extending from the first side of the closure plate, and the second portion comprises a second rail member configured to slide on the first rail member.

In some embodiments, the second rail member is configured to slide on the first rail member in a sliding direction parallel to the longitudinal direction.

In some embodiments, one of the first rail member and the second rail member comprises an external T-track or L-track and the other of the first rail member and the second rail member comprises an internal T-track or L-track.

In some embodiments, the clamp fixture is integrally formed with the closure plate.

In some embodiments, the clamp fixture comprises a passage extending into the first side of the closure plate.

In some embodiments, the clamp and the clamp fixture comprise interlocking parts configured to hold the clamp at the second clamp position.

In some embodiments, the interlocking parts comprise a one-way ratchet.

In some embodiments, the interlocking parts comprise: at least one first rib on the clamp, the at least one first rib extending perpendicular to the depth direction; at least one second rib on the clamp fixture, the at least one second rib extending perpendicular to the depth direction; and wherein the at least one first rib and the at least one second rib are positioned to overlap with respect to the depth direction.

In some embodiments, the at least one first rib is mounted to the clamp by a flexible arm configured to allow selective movement of the at least one first rib in a direction perpendicular to the depth direction to thereby disengage the at least one first rib from the at least one second rib.

In some embodiments, the vent opening is configured to allow manual movement of the clamp from the first clamp position to the second clamp position, by a user reaching through the vent opening from the second side of the closure plate to the first side of the closure plate.

In some embodiments, the window installation system further includes a duct fitting extending from the closure plate at the vent opening and configured to connect with a hot air duct to form a continuous passage between the hot air duct and the vent opening.

In some embodiments, the duct fitting extends from a non-circular end at the vent opening to a circular end spaced from the vent opening.

In some embodiments, the non-circular end has a first geometric center axis along the depth direction and the circular end has a second geometric center axis along the depth direction, and the second geometric axis is offset from the first geometric axis along at least one of the longitudinal direction and the transverse direction.

In some embodiments, the duct fitting extends from the first side of the closure plate.

In some embodiments, the duct fitting extends from the second side of the closure plate.

In some embodiments, the clamp fixture is selectively and alternatively securable to the closure plate with the duct fitting extending from the first side of the closure plate or the second side of the closure plate.

In some embodiments, the longitudinal location is closer to the first longitudinal end than the second longitudinal end.

In some embodiments, the closure plate comprises a first closure plate portion defining the first longitudinal end, and a second closure plate portion defining the second longitudinal end, wherein the second closure plate is telescopically mounted to move along the longitudinal direction relative to the first closure plate portion between a first configuration in which the first longitudinal end is spaced from the second longitudinal end by a first longitudinal distance, and a second configuration in which the first longitudinal end is spaced from the second longitudinal end by a second longitudinal distance, the second longitudinal distance being greater than the first longitudinal distance.

In some embodiments, the vent opening is provided through the first closure plate portion.

BRIEF DESCRIPTION OF THE DRAWINGS

Embodiments will now be described, strictly by way of example, with reference to the accompanying drawings, in which.

DESCRIPTION OF EXEMPLARY EMBODIMENTS

Figure 1:
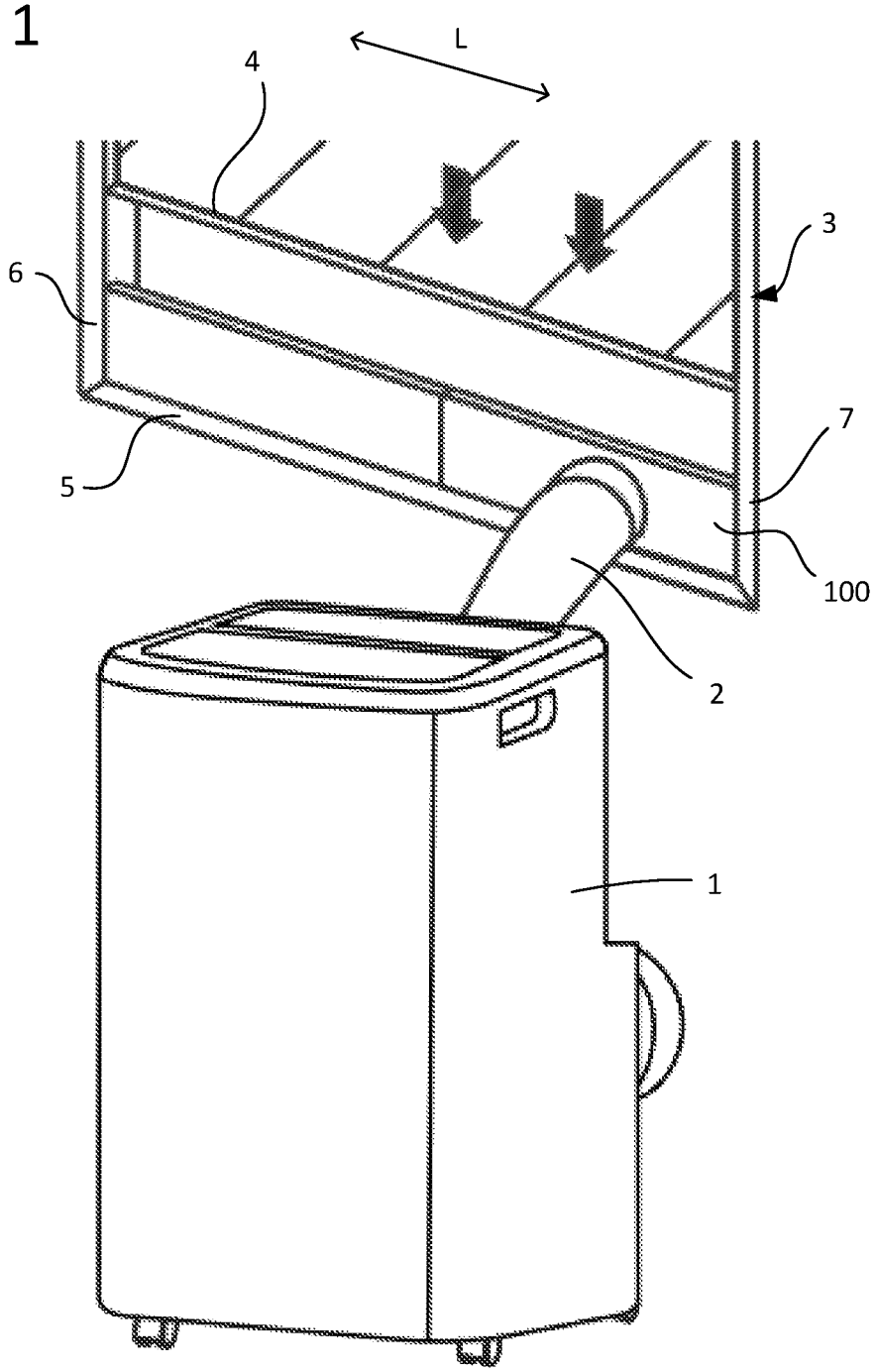
FIG. 1 illustrates a portable air conditioning unit installation.

FIG. 1 illustrates an example of a portable air conditioning unit 1 installed in a room, with a hot air duct 2 extending from the portable air conditioning unit to a window 3. The hot air duct 2 is secured to the window 3 by a window installation system 100, such as described herein. FIG. 1 shows the window sash 4 being moved down to capture the window installation system between the sash 4 and the window frame 5. The window installation system 100 extends in a longitudinal direction L to abut opposed lateral window frame sides 6, 7.

The portable air conditioning unit 1 may have any suitable construction for providing cooled air to the room. For example, the portable air conditioning unit 1 may have a housing that contains a compressor, condenser, throttle (e.g., orifice plate, capillary tube, thermal expansion valve, etc.), and evaporator, as known in the art. The hot air duct 2 connects to the portable air conditioning unit 1 to convey hot air away from the portable air conditioning unit 1. It will also be appreciated that the window installation system 100 may be used to connect other appliances or devices to the window 3. For example, the duct 2 may be an exhaust air duct from a stovetop fan, a waste discharge duct from power equipment (e.g. sawdust or the like), or an exhaust duct from an internal combustion engine or air evacuator (e.g., for operating in auto service shops).

Figure 2A:
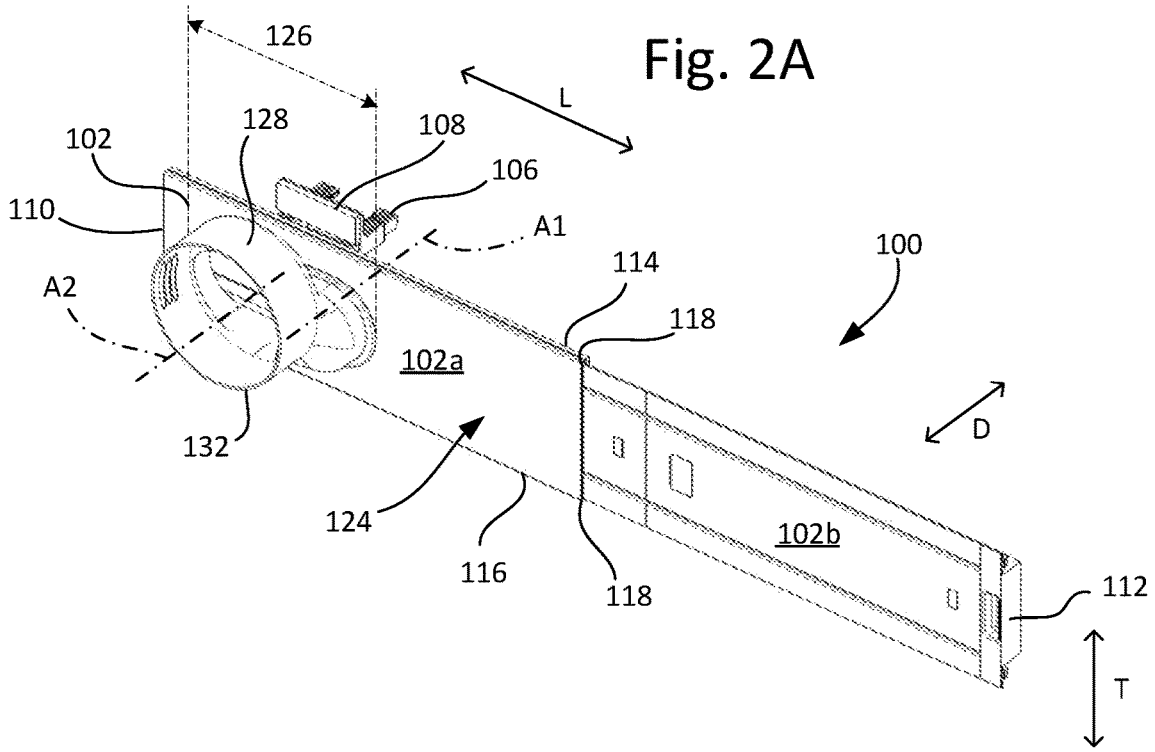
FIGS. 2A and 2B are front and rear isometric views, respectively, of an exemplary window installation system.
Figure 2B:
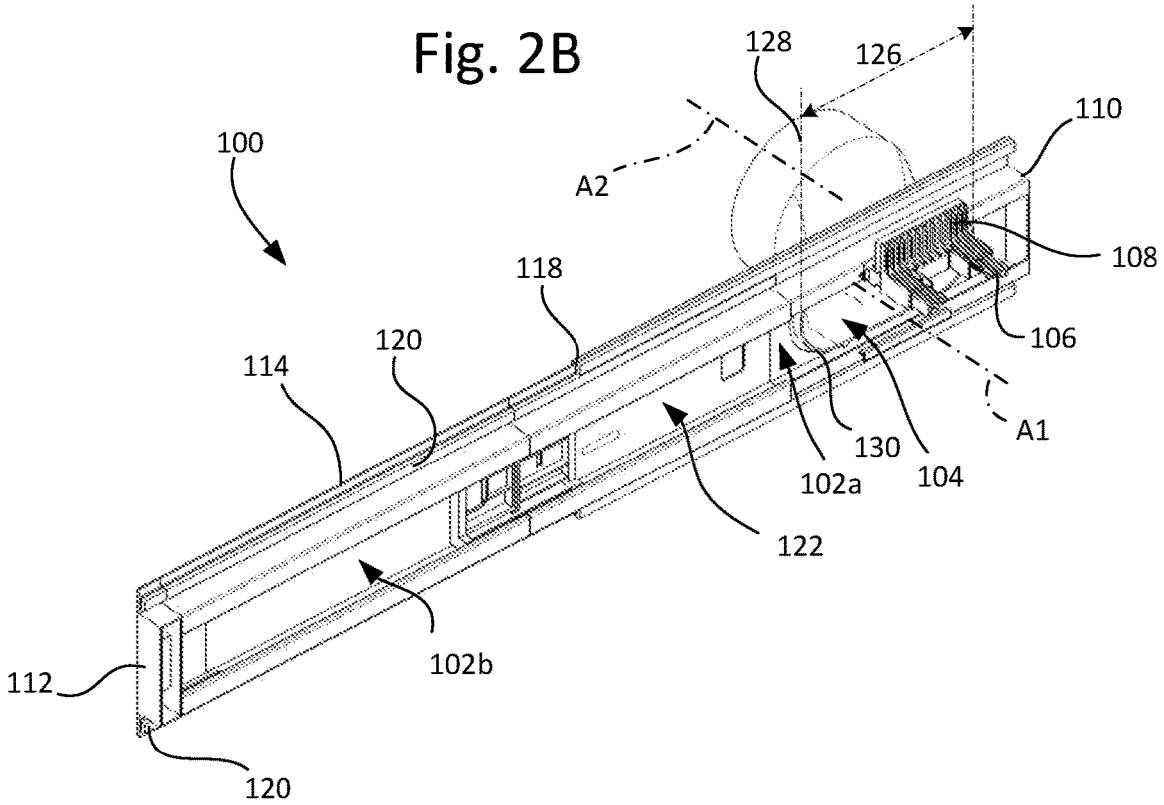
Figure 3:
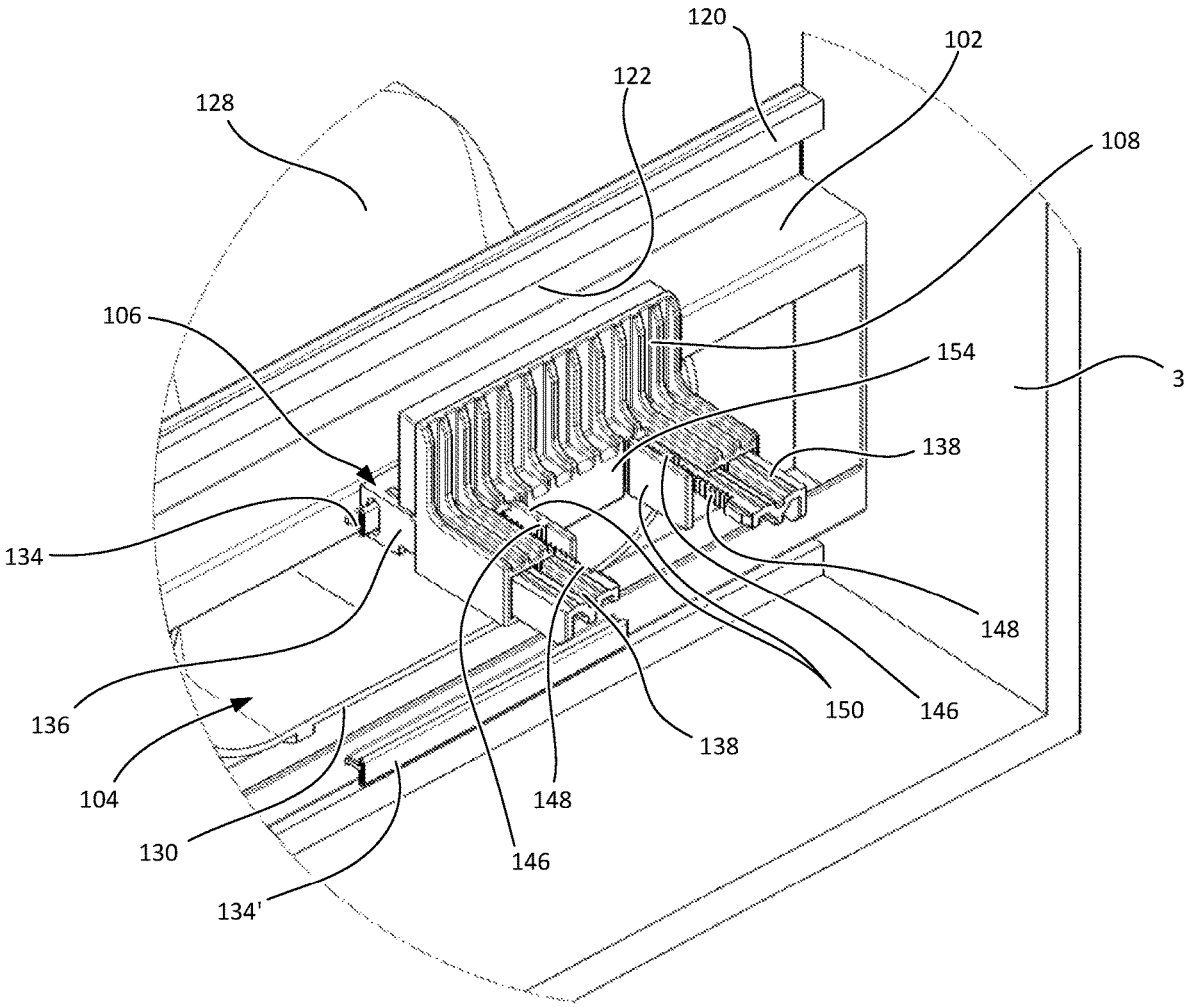
FIG. 3 is a detail rear isometric view of the window installation system of FIGS. 2A and 2B.

Referring now to FIGS. 2 and 3, the window installation system 100 generally comprises a closure plate 102, a vent opening 104, a clamp fixture 106, and a clamp 108.

The closure plate 102 extends in a longitudinal direction L between a first longitudinal end 110 and a second longitudinal end 112, and in a transverse direction T, which is perpendicular to the longitudinal direction L, between a first transverse end 114 and a second transverse end 116. The closure plate 102 is a generally continuous and air-tight solid structure, such as a plastic or metal sheet or the like. The closure plate 102 may be generally planar or have planar portions, such as shown, but this is not strictly required. The closure plate 102 also may have various structural features to help it form an air-tight seal with the window 3. Non-limiting examples of such features are described below. It will be understood that the term "air-tight" refers to generally preventing large volumes of air from passing through, but some air leakage may be present.

The closure plate 102 may comprise a single structure having a fixed shape, or it may be reconfigurable to fit different window sizes. For example, the closure plate 102 may comprise a first closure plate portion 102*a* extending to the first longitudinal end 110, and a second closure plate portion 102*b* extending to the second longitudinal end 112, with the second closure plate portion 102*b* being movable along the longitudinal direction L relative to the first closure plate portion 102*a*. In this case, the second closure plate portion 102*b* is telescopically movable between a first configuration in which the first longitudinal end 110 is spaced from the second longitudinal end 112 by a first longitudinal distance, and a second configuration in which the first longitudinal end 110 is spaced from the second longitudinal end 112 by a second longitudinal distance, with the second longitudinal distance being greater than the first longitudinal distance. Thus, the first closure plate 102*a* and second closure plate 102*b* can be telescopically expanded or contracted to fit different size windows.

The first closure plate portion 102*a* and second closure plate portion 102*b* may be telescopically connected by mutually-engaging sliding tracks or the like. In the shown example, the first closure plate portion 102*a* has inwardly-turned lips 118 at the first transverse end 114 and the second transverse end 116, which capture the second closure plate portion 102*b* in both the transverse direction T and in a depth direction D extending perpendicular to the longitudinal direction L and the transverse direction T. Thus, the second closure plate portion 102*b* is free to slide within the lips 118 along the longitudinal direction L, to thereby provide a telescoping motion, but other movement relative to the first closure plate portion 102*a* is restricted. It will be understood that the first closure plate portion 102*a* and second closure plate portion 102*b* collectively define the first transverse end 114 and the second transverse end 116, regardless of their state of telescopic extension.

Other embodiments may have different movable or telescoping structures, or provide other means for changing the geometry of the closure plate 102. For example, the closure plate 102 may have an expandable bellows at one or both ends, or the like.

Any suitable mechanism may be used to hold the first closure plate portion 102*a* and the second closure plate portion 102*b* in one or more telescopic positions. For example, the first longitudinal end 110 and the second longitudinal end 112 may each have a clip that frictionally engages a portion of the window frame, or they may be attached to the window frame with fasteners, such as screws. As another example, the first closure plate portion 102*a* and second closure plate portion 102*b* may be held in the telescopic position by friction, by engagement with the window sash and frame, or by a clamp or other mechanism located at the intersection of the first closure plate portion 102*a* and the second closure plate portion 102*b*. In a preferred embodiment, no separate fasteners or screws are a required to hold the first closure plate portion 102*a* and second closure plate portion 102*b* at any particular state of extension, but this is not required in all embodiments. It is also envisioned that multiple additional closure plate portions may be provided (e.g., a third closure plate portion telescopically joining the first closure plate portion 102*a* to the second closure plate portion 102*b*, or a third closure plate portion forming the first longitudinal end 110 and telescopically connected to the first closure plate portion 102*a* to extend opposite the second closure plate portion 102*b*).

As noted above, the closure plate 102 also may include features to help form an air-tight seal between the closure plate 102 and the window 3. For example, the closure plate 102 may include seals 120 that extend along the longitudinal direction L and abut the window sash and window frame when the closure plate 102 is installed. In this example, the first closure plate portion 102*a* and second closure plate portion 102*b* each has a portion of a seal 120 formed thereon, and seals 120 are provided at both the first transverse end 114 and second transverse end 116. The seals 120 may be flexible rubber seals, foam seals, or the like. Similarly, the first end 110 and second end 112 may include seals or sealing structures to form an air-tight seal with opposite sides of the window frame. Other alternatives and variations of seals and seal locations will be apparent to persons of ordinary skill in the art in view of the present disclosure.

The vent opening 104 is a passage that extends through the closure plate 102 from a first side 122 of the closure plate 102 to a second side 124 of the closure plate 102. The vent opening 104 is positioned along the longitudinal direction L at a location 126 between the first end 110 and second end 112 of the closure plate 102. The location 126 may be centered on the closure plate 102, or centered on one portion 102*a* of the closure plate. Alternatively, and more preferably, the vent opening location 126 is offset towards the first longitudinal end 110 of the closure plate 102. This arrangement is expect to allow a more convenient location to mount the hot air duct 2, particularly when the longitudinal direction L extends vertically (see, e.g., FIGS. 6A and 6B). This also allows a second closure plate portion 102*b* to have a greater longitudinal length without interfering with the vent opening 104 when the second closure plate portion 102*b* is telescopically retracted relative to the first closure plate portion 102*a*.

The vent opening 104 may have any shape and size suitable for conveying the desired volume of air or gas to outside the window 3. In the shown example, the vent opening 104 has an elongated rectangular shape with semi-circular ends, but other shapes (e.g., rectangular, square, circular, hexagonal, oval, etc.) may be used. The elongated shape can be preferred to help reduce the dimension of the window installation system 100 in the transverse direction T.

The window installation system 100 also may include a duct fitting 128 that extends from the closure plate 102. The duct fitting 128 extends from one side of the closure plate 102 (in this case, the second side 124), from a first fitting end 130 that surrounds the vent opening 104 (either within the vent opening's perimeter or outside the vent opening's perimeter) to a second fitting end 132 that is spaced from the closure plate 102. The first fitting end 130 may be shaped to match the shape of the vent opening 104, and the second fitting end 132 may be shaped to match the shape of the hot air duct 2. In this example, first fitting end 130 has a rectangular shape with semi-circular ends, and the second fitting end 132 has a circular shape. The intermediate portion of the duct fitting 128 preferably is shaped with a continuous smooth profile to encourage smooth and efficient airflow from the second fitting end 132 to the first fitting end 130 and out through the vent opening 104.

The duct fitting 128 may be formed as part of the closure plate 102, or provided as a separate part that is attached to the closure plate 102. For example, the second fitting end 128 may pass through the vent opening 104 and be secured to the closure plate 102 by snaps that engage the vent opening 104. In this case, the second fitting end 132 defines the boundary of air flow passing through the vent opening 104. The second fitting end 132 may include features to securely connect to the hot air duct 2. For example, the second fitting 132 may have threads, barbs, or bayonet fittings that engage similar shapes on the hot air duct 2. Other alternatives and variations will be apparent to persons of ordinary skill in the art in view of the present disclosure.

The first fitting end 130 may be offset from the second fitting end 132, such that the airflow moves in the longitudinal direction L and/or transverse direction T as it passes through the duct fitting 128. For example, the first fitting end 130 may define a first geometric center axis A1 that is offset, in one or both of the longitudinal direction and the transverse direction T, from a second geometric axis A2 defined by the second fitting end 132. As used herein, the "geometric center axis" is the arithmetic mean position of all the points in a shape defined by the cross-section of the respective fitting end 130, 132 (i.e., the centroid), as viewed along the depth direction D. Such an offset may be beneficial to help clear obstacles such as a window sill or the like, and to ease installation of the hot air duct 2.

Figure 4:
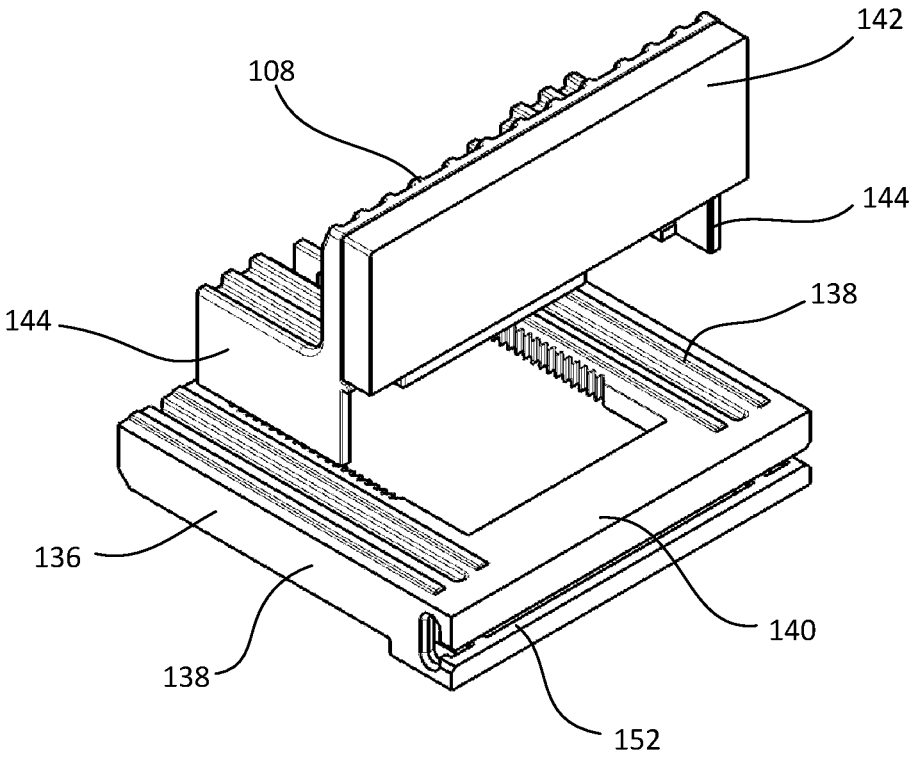
FIG. 4 is a front isometric view of the clamp and a portion of the clamp fixture of the window installation system of FIGS. 2A and 2B, shown in exploded view.
Figure 5:
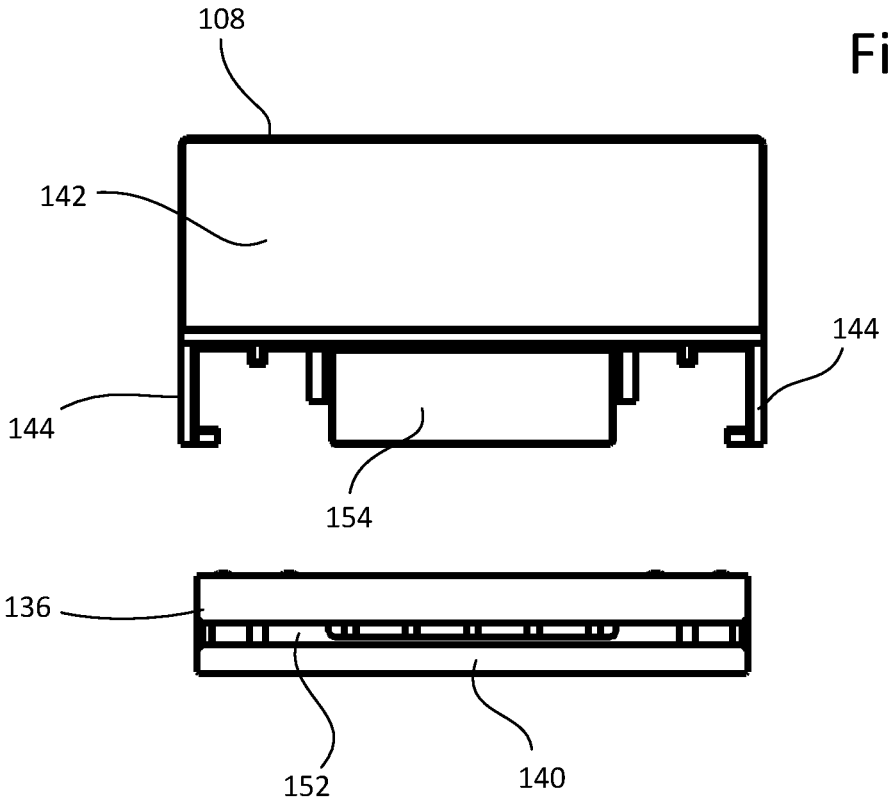
FIG. 5 is a front elevation view of the clamp and a portion of the clamp fixture of the window installation system of FIGS. 2A and 2B, shown in exploded view.

Referring now also to FIGS. 3-5, examples of an exemplary clamp fixture 106 and clamp 108 are described in more detail.

The exemplary clamp fixture 106 is positioned adjacent to the vent opening 104. The clamp fixture 106 is also at the same longitudinal position 126 as the vent opening 104—that is, at least some part of the clamp fixture 106 overlaps the vent opening 104 with respect to the longitudinal direction L. In some cases, the respective longitudinal midpoints (i.e., midpoints along the longitudinal direction L) of the clamp fixture 106 and the vent opening 104 may be at the same longitudinal position 126 (i.e., the clamp fixture 106 may be centered on the vent opening 104 along the longitudinal direction L), but this is not strictly required.

The clamp fixture 106 may comprise any structure that is suitable for connecting the clamp 108 to the closure plate 102 so that the clamp 108 can move relative to the closure plate 102. In the example of FIGS. 2A-3, the clamp fixture 106 comprises a first portion 134 and a second portion 136. The first portion 134 is rigidly fixed directly to the cover plate 102. For example, the first portion 134 may be a part that is rigidly connected (e.g., by welding or fasteners) to the cover plate 102, or the first portion 134 may be integrally formed (e.g., as by unitary plastic molding) as part of the cover plate 102. The second portion 136 is selectively mountable to the first portion 134, and may be removable from the first portion 134, and/or movable relative to the first portion 134 when they are connected.

In the example of FIGS. 2A-5, the first portion 134 comprises a first rail member extending from the first side 122 of the closure plate 102, and the second portion 136 comprises a second rail member that is configured to slide on the first rail member. The rail members engage each other to allow relative sliding between the first portion 134 and the second portion 136 along one direction, while preventing relative movement in other directions. In this case, the rail members are configured to allow the second portion 136 to slide relative to the first portion 134 along a direction that is parallel to the longitudinal direction L.

In this example, the first rail member is formed as an external T-track, and the second rail member is formed as an internal T-track 152. However, the first rail member may be an internal T-track, and the second rail member may be an external T-track. Also, other track shapes may be used in other embodiments. For example, the crossbar of the T-track may be replaced by a circular profile to give the track a "lollipop" shape. One or both rail members also may include travel stops, position locks, or the like. For example, one end of the internal T-track may be closed to prevent over-installation, or the external T-track may include barbed ends that snap around the ends of the internal T-track to capture the internal T-track at a fixed location along the external T-track. As another example the eternal T-track might have protrusions that fit into detents along the internal T-track to provide discrete resilient stops at one or more locations. Other alternatives and variations will be apparent to persons of ordinary skill in the art in view of the present disclosure.

The sliding arrangement shown in this example can allow the user to adjust the position of the second portion 136 relative to the first portion 134 to account for installation requirements (e.g., to avoid a window latch), but this is not strictly required. The first portion 134 of the clamp fixture 106 also may include multiple separate parts that provide alternative locations for connecting with the second portion 136 of the clamp fixture 106. For example, the first portion 134 may comprise one T-track located between the vent opening 104 and the first transverse end 114 of the closure plate 102, and a second T-track 134' located between the vent opening 104 and the second transverse end 116 of the closure plate 102. With this construction, the user can selectively and alternately secure the second portion 136 of the clamp fixture 106 to either first portion 134, 134', depending on the particular installation requirements.

As noted above, the clamp fixture 106 is configured to connect the clamp 108 to move relative to the closure plate 102. In this example, the clamp fixture 106, and more particularly the second portion 136 of the clamp fixture 106, comprises two parallel posts 138, which are spaced from each other along the longitudinal direction L, and which extend parallel to the depth direction D. The posts 138 are joined by a longitudinally-extending base 140, in which the internal T-track is formed. The posts 138 provide sliding supports for the clamp 108, as discussed below.

Other embodiments may use other clamp fixture 106 structures to provide a movable connection between the closure plate 102 and the clamp 108. For example, the clamp fixture 106 may comprise a single post 138, or more than two posts 138. In one example, the clamp fixture 106 may comprise two posts 138 or other parts that are spaced on either side of the vent opening 104 along the longitudinal direction L but without either individual post 138 or other part being within the longitudinal space of the vent opening location 126; in this case, however, the two posts 138 or other parts nevertheless collectively define a clamp fixture 106 that is located at the vent opening location 126 (i.e., the parts of the clamp fixture 106 may straddle the vent opening 104 along the longitudinal direction L). As another example, the posts 138 may not be parallel with the depth direction. In other cases, the clamp fixture 106 may comprise one or more passages that extend into or through the closure plate 102, such as discussed below. Other alternatives and variations of clamp fixtures 106 will be apparent to persons of ordinary skill in the art in view of the present disclosure.

The clamp 108 is movably mounted to the clamp fixture 106, and has a clamp surface 142 facing the first side 122 of the closure plate 102. Thus, the clamp 108 is movable relative to the clamp fixture 106 to clamp onto and hold a window sash or the like between the clamp surface 142 and an adjacent portion of the first side 122 of the closure plate 102. The clamp surface 142 and the adjacent portion of the first side 122 of the closure plate 102 may comprise simple plastic or metal faces, which may be flat or shaped to conform to a window sash or the like, or one or both parts may have grip-enhancing or air-sealing features, such as elastic seals, foam rubber pads, or the like.

Figure 8:
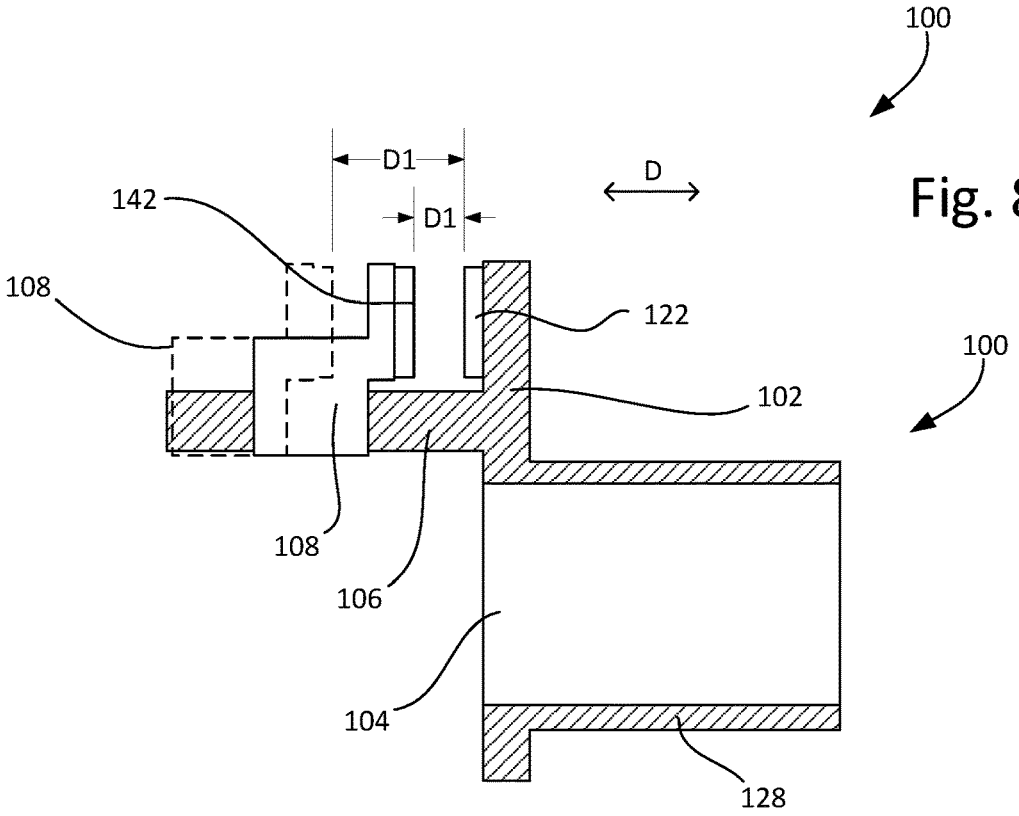
FIG. 8 is a side cross-section view of another exemplary window installation system.

As shown in FIG. 8, the clamp 108 may be movable along the depth direction D between a first clamp position (broken lines) in which the clamp surface 142 is a first distance D1 from the first side 122 of the closure plate 102, and a second clamp position (solid lines) in which the clamp surface 142 is a second distance D2 from the first side 122 of the closure plate 102 in the depth direction D. The second distance D2 is less than the first distance D1, and the total length between the first distance D1 and the second distance D2 may be selected to fit around window sashes or other structures having a range of different sizes.

The clamp fixture 106 and clamp 108 may have any structures suitable for allowing the clamp 108 to move relative to the closure plate 102. In this example, the clamp 108 is formed with channels 144 that surround and slide along respective ones of the two posts 138 of the second portion 136. The posts 136 and channels 144 may be rectilinear (such as shown), cylindrical, or any other suitable shape. In the shown examples, the channels 144 and posts 138 are linear along the depth direction D, but alternatively they may have curved shapes, such that the clamp 108 moves along a curve between the first clamp position and the second clamp position. The clamp 108 and clamp fixture 106 also may include a mechanical linkage, pivots, and so on. For example, the clamp 108 may be mounted to the clamp fixture by a pivot having a rotation axis that extends in the longitudinal direction L or transverse direction T.

Any suitable holding mechanism may be used to hold the clamp 108 in the desired position relative to the closure plate 102 to thus hold a window sash or the like. For example clips or clamps may be installed on the posts 136 to hold the clamp 108 against backing away from the closure plate 102. The holding mechanism preferably is mounted on or integrally formed with one or both of the clamp fixture 106 and the clamp 108, such that no additional parts are necessary to secure the clamp 108 in a holding position.

In the embodiment shown in FIGS. 3-5, the clamp 108 and the clamp fixture 106 have interlocking parts configured to hold the clamp 108 at the second clamp position. These interlocking parts may be formed as one or more first ribs 146 on the clamp 108, which engage one or more second ribs 148 on the clamp fixture 106. The first ribs 146 and second ribs 148 extend perpendicular to the depth direction D (or whatever direction the clamp 108 moves in to clamp against the window sash or the like). The first ribs 146 and second ribs 148 are positioned to overlap each other along the depth direction D. Thus, one or both of the first ribs 146 and the second ribs 148 must be displaced in a direction perpendicular to the depth direction D to allow free movement of the clamp 108 relative to the clamp fixture 106.

Selective displacement of the first ribs 146 relative to the second ribs 148 may be provided by mounting one or both of the first ribs 146 and the second ribs 148 on flexible arms 150. In this example, the first ribs 146 are mounted on flexible arms 150, and the flexible arms 150 may be displaced manually by the user (e.g., by squeezing the free ends of the arms 150 together) to disengage the first ribs 146 from the second ribs 148 and allow free movement of the clamp 108 relative to the clamp fixture 106. The arms 150 also may be displaced by interaction between the first ribs 146 and the second ribs 148. For example, the first ribs 146 and/or the second ribs 148 may have tapered faces that face each other as the clamp 108 moves towards the second clamp position. The tapered faces act as wedges to drive the flexible arms 150 perpendicular to the depth direction D as a force is applied to move the clamp 108 along the depth direction D. Thus, the first ribs 146 and second ribs 148 can act as a one-way ratchet that allows the clamp 108 to be moved towards the second clamp position without having to manually release the first ribs 146 from the second ribs 148, while preventing movement of the clamp 108 towards the first clamp position until the user manually disengages the first ribs 146 from the second ribs 148. This one-way ratchet arrangement is expected to be particularly useful to allow relatively easy engagement of the clamp 108 with the window sash 4.

Other mechanisms may be used in other embodiments to control the position of the clamp 108 relative to the closure plate 102. For example, the clamp 108 may have pins that fit into holes along the clamp fixture 106. Other alternatives and variations will be apparent to persons of ordinary skill in the art in view of the present disclosure.

In some embodiments, the vent opening 104 and clamp 108 may be configured to allow the user to operate the clamp 108 by reaching through the vent opening 104 from the second side 124 of the closure plate 102 to the first side 122 of the closure plate 102. For example, the vent opening 104 (or duct fitting 128, if pre-installed) may be dimensioned to fit all or part of a typical human hand (e.g., at least about 5 inches in the longitudinal direction L and 2 inches in the transverse direction T), and the clamp 108 may have a handle portion 154 that is shaped and positioned to receive one or more fingers of the hand.

Figure 6A:
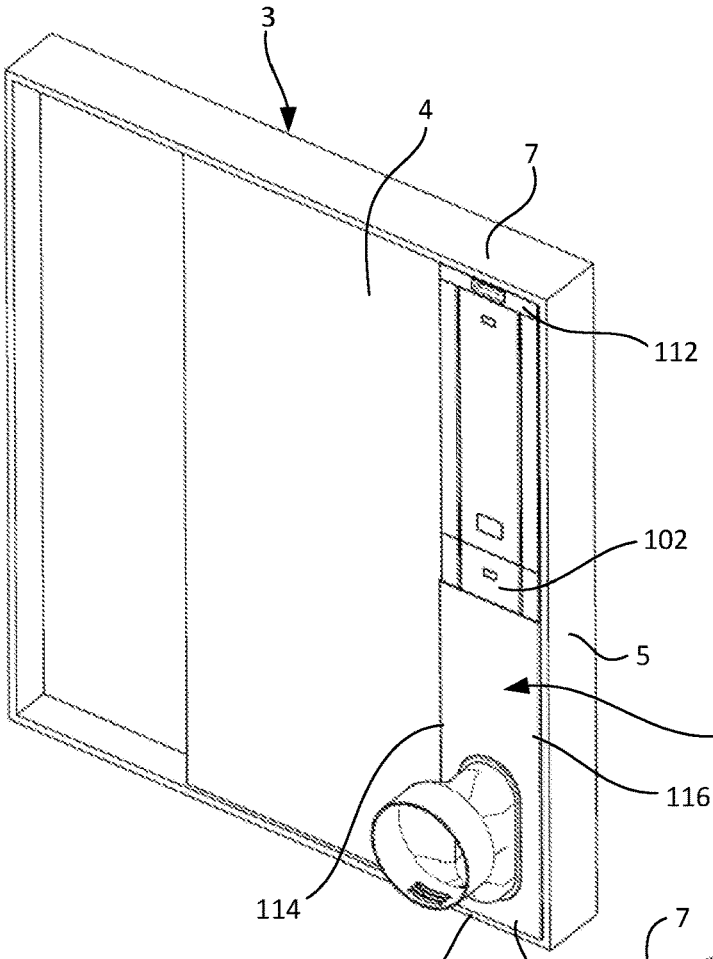
FIGS. 6A and 6B are front and rear isometric views, respectively, of the exemplary window installation system of FIGS. 2A and 2B, shown installed in a window.
Figure 6B:
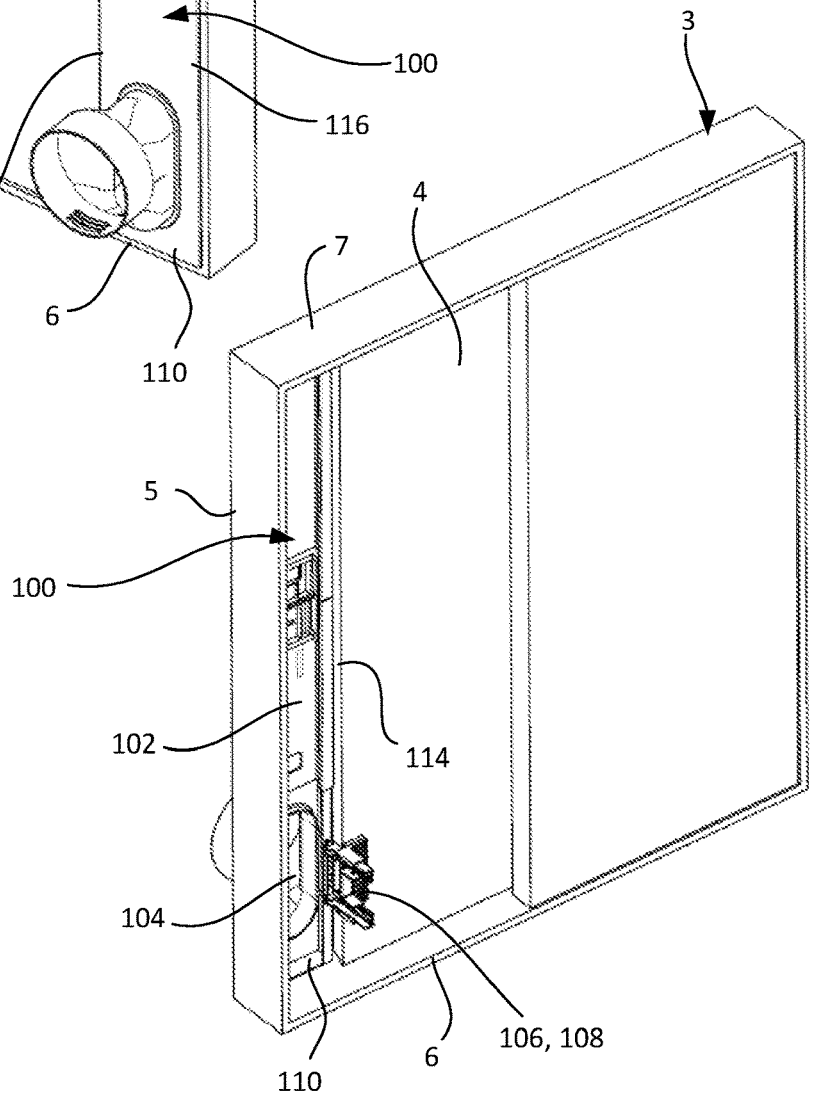
Figure 7A:
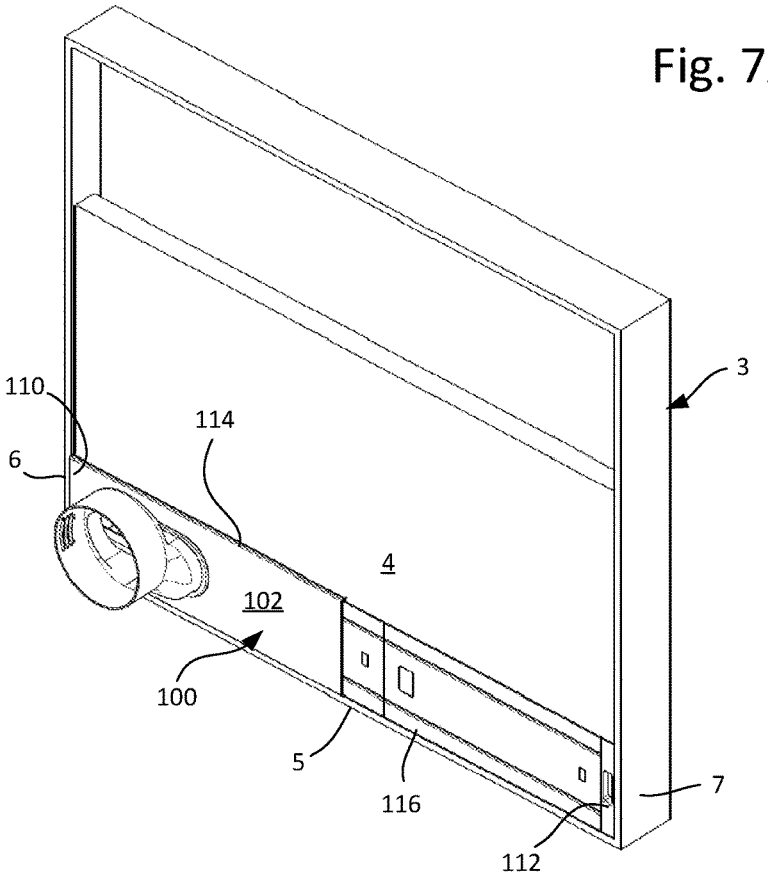
FIGS. 7A and 7B are front and rear isometric views, respectively, of the exemplary window installation system of FIGS. 2A and 2B, shown installed in another window.
Figure 7B:
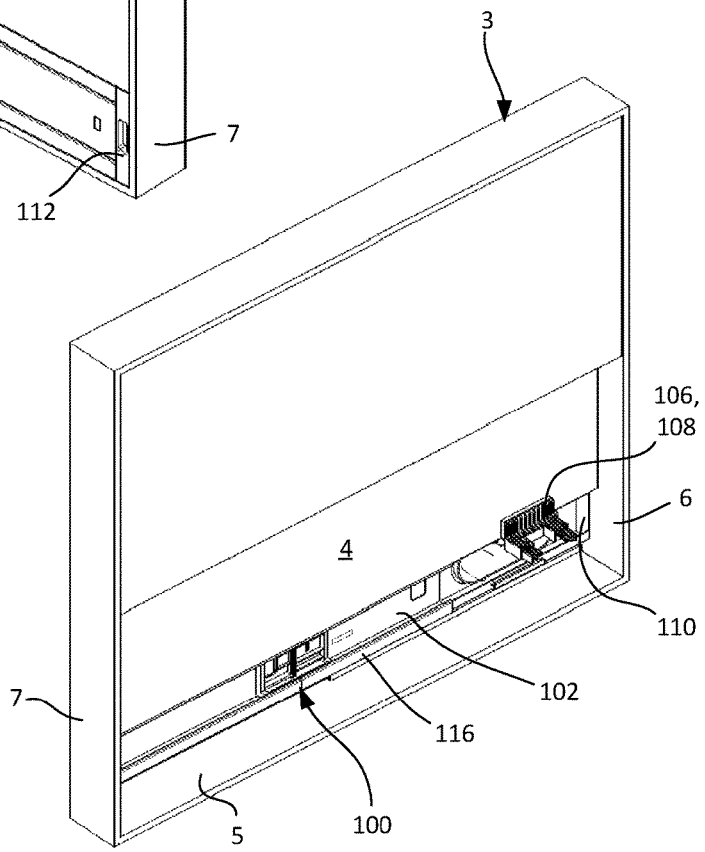

FIGS. 6A-7B show two different ways in which the window installation system 100 may be secured to a window 3. FIGS. 6A and 6B show the window installation system 100 secured with the longitudinal direction oriented vertically, and FIGS. 7A and 7B show the window installation system 100 secured with the longitudinal direction oriented horizontally. In each case, the window installation system is secured with the first longitudinal end 110 against a first wall 6 of the window frame and the second longitudinal end against a second wall 7 of the window frame, with the second wall 7 being parallel to and facing the first wall 6. The window sash 4 is pressed against the first transverse end 114 of the closure plate 102, and the second transverse end 116 of the closure plate is pressed against a third wall 5 of the window frame. The particular location of the vent opening 104 relative to the window frame (i.e., the selection of installing it next to the second wall 7 or third wall 5), can be changed by installing the removable portion 136 of the clamp fixture 106, and thus the clamp 108, on the appropriate first portion 134, 134' of the clamp fixture 106.

FIGS. 8-11 show various alternative embodiments of window installation systems 100. The structures in these embodiments may be used in any other embodiment, where suitable. Each of these embodiments also may include structures such as mechanisms for holding the clamp 108 in fixed positions, and the like, such as described above.

FIG. 8 shows a window installation system 100 in which the clamp fixture 106 is integrally formed with the closure plate 102. The clamp fixture 106 may comprise one or more posts, such as described previously herein, or other structures. The clamp 108 is mounted to the clamp fixture 106 to move along the clamp fixture 106.

Figure 9:
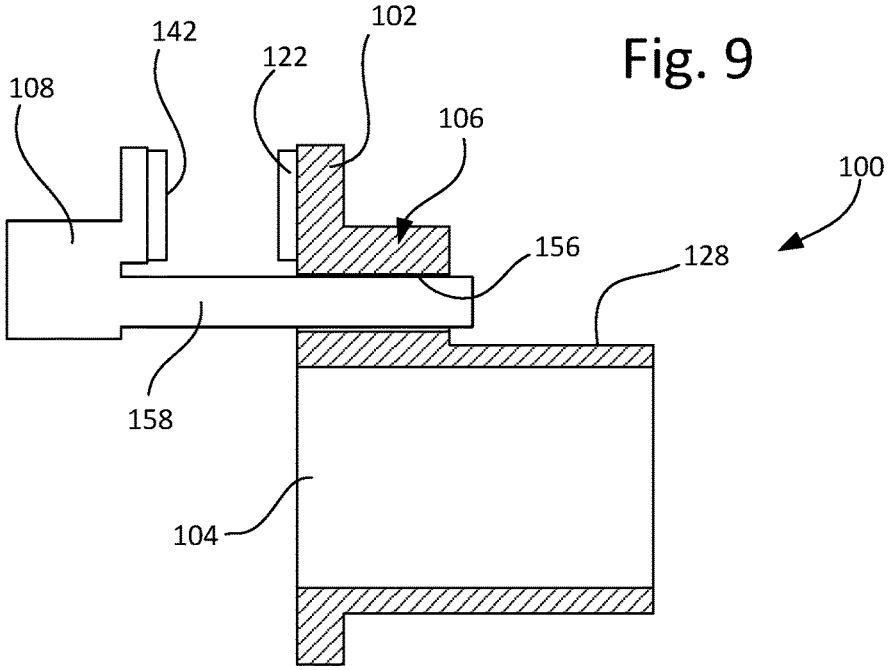
FIG. 9 is a side cross-section view of another exemplary window installation system.

FIG. 9 shows a window installation system 100 in which the clamp fixture 106 comprises one or more passages 156 extending into the first side 122 of the closure plate 102. The clamp 108 includes one or more posts 158 that extend into the one or more passages 156.

Figure 10:
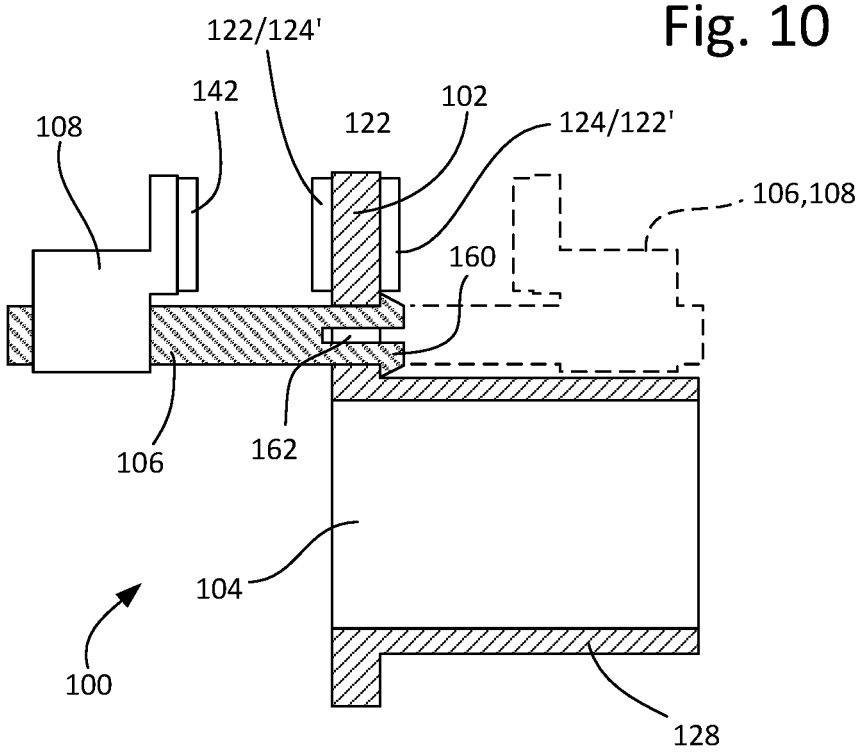
FIG. 10 is a side cross-section view of another exemplary window installation system.

FIG. 10 shows a window installation system 100 in which the clamp fixture 106 is selectively and alternately connectable to either side of the closure plate 102. The clamp fixture 106 may comprise, for example, a barbed post 160 that snaps into a corresponding hole 162 in the closure plate 102, from either side of the closure plate 102. The side of the closure plate 102 from which the clamp fixture 106 protrudes defines the first side 122 of the closure plate 102. Thus, when the clamp fixture 106 and clamp 108 are installed as shown in solid lines, the left side of the closure plate 102 is the first side 122, and the right side of the closure plate 102 is the second side 124. Alternatively, if the clamp fixture 106 and clamp 108 are installed as shown in broken lines, the right side of the closure plate 102 is the first side 122', and the left side of the closure plate 102 is the second side 124'. This embodiment allows the user to determine which side of the closure plate 102 will face the window sash at the time of installation.

Figure 11:
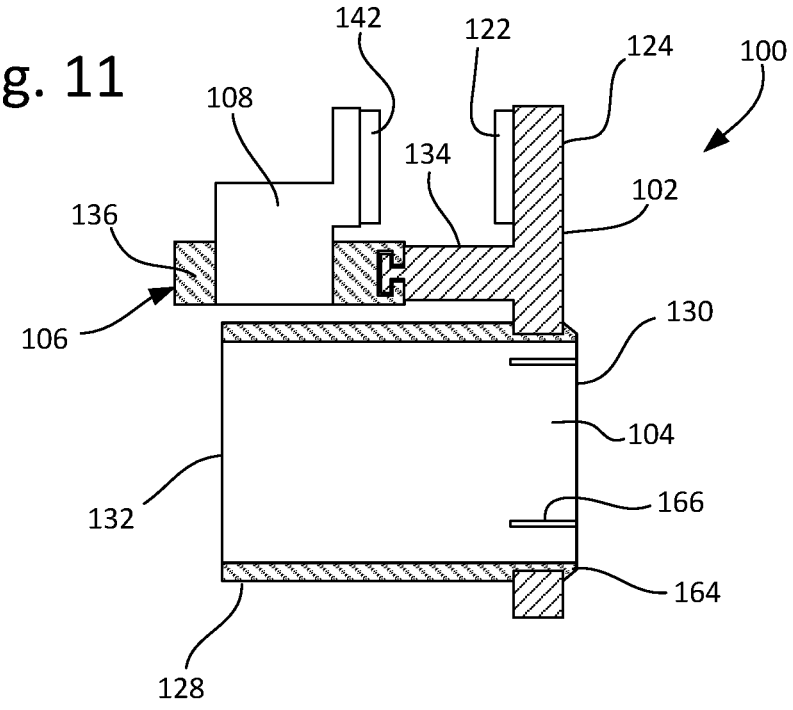
FIG. 11 is a side cross-section view of another exemplary window installation system.

FIG. 11 shows a window installation system 100 in which the duct fitting 128 is installed on the first side 122 of the closure plate 102, rather than the second side 124 of the closure plate 102 as a shown in the previous examples. The duct fitting 128 may be permanently attached in this position, such as by integrally molding the duct fitting 128 with the closure plate 102. Alternatively, the duct fitting 128 may be selectively securable to either side of the closure plate 102. For example, the first fitting end 130 may have a barbed lip 164 that snaps into place within the vent opening 104, and relief slots 166 that allow the barbed lip 164 to flex as it is inserted into the vent opening 104, or it may have a multiple individual flexible tabs that snap around the inner lip of the vent opening 104 by pushing the duct fitting 128 towards the closure plate 102. In other cases, the duct fitting 128 may be secured to the closure plate 102 by a gasket or other flexible material that allows the duct fitting 128 to be attached to (and possibly removed from) the closure plate 102. Other alternatives and variations will be apparent to persons of ordinary skill in the art in view of the present disclosure.

Figure 12:
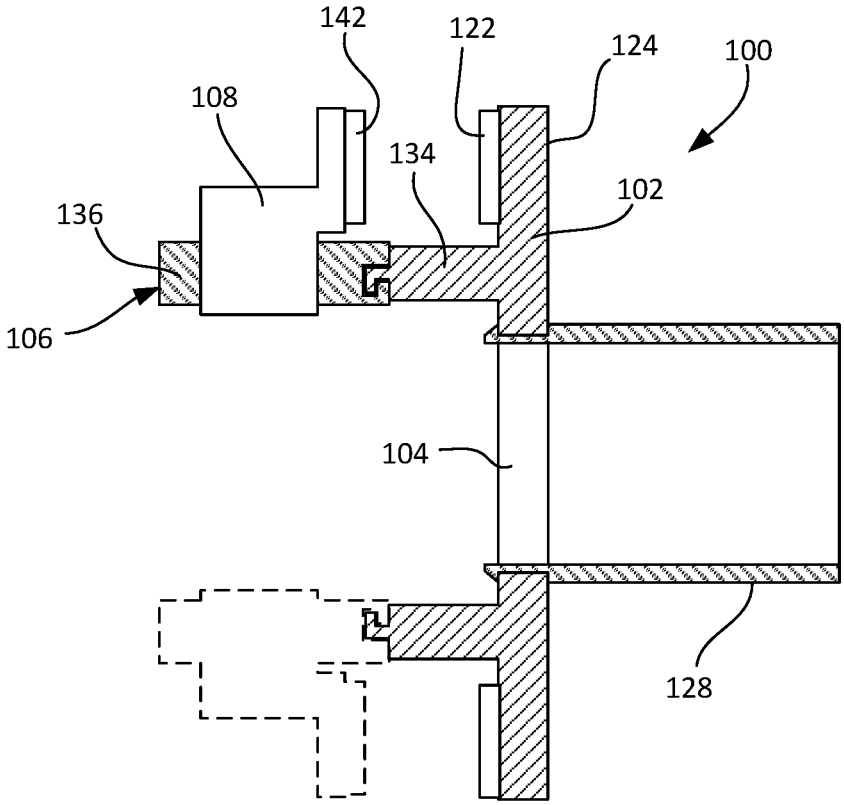
FIG. 12 is a side cross-section view of another exemplary window installation system.

FIG. 12 shows another example of a window installation system 100 in which the T-track connecting the first and second portions 134, 136 of the clamp fixture 106 are replaced by external and internal tracks formed with L-shaped profiles—i.e., L-tracks. Like the embodiment of FIG. 3, the first portion 134 includes a second mounting location 134' on an opposite side of the vent opening 104, but this is not strictly required.

Embodiments such as those described herein are expected to provide various benefits over conventional window installation systems. For example, the window installation systems 100 may be configured to install to a window without any tools or additional fasteners. In this case, the clamp 108 provides a single activated connection between the window installation system 100, while the remainder of the window installation system 100 simply abuts or fits into existing parts of the window. Installation may be performed by placing the window installation system 100 into the open window, expanding the closure plate 102 (if necessary) to abut the first longitudinal end 110 and the second longitudinal end 112 with opposite parts of the window frame, closing the window sash to capture the window installation system 100 in place, and then operating the clamp 108 to secure the window installation system 100 to the window sash.

In some cases, the first longitudinal end 110 and second longitudinal end 112 also may be inserted into window tracks to help provide a secure connection at those locations. To this end, the closure plate 102 may be formed such that the first longitudinal end 110 and second longitudinal end 112 are located between the first side 122 of the closure plate 102 and the clamp 108 with respect to the depth direction D. This positions the first longitudinal end 110 and the second longitudinal end 112 within the travel path of the sash, and thus facilitates insertion into any window sash tracks that may be present in the window frame. A similar benefit may be obtained by shaping the second lateral end 116 to fit into a sash receptacle, if present.

Embodiments preferably have a single clamp 108, which helps improve operating simplicity and reduce costs. The clamp 108 also preferably is positioned adjacent to the vent opening 104, which reduces any leverage against the clamp 108 that might be generated when forces are applied at the vent opening 104 by moving the hot air duct 2. This is particularly preferred when the window installation system 100 has only one clamp 108.

While such benefits may be obtained in some embodiments, it will be understood that the claims are not necessarily limited to structures that achieve such benefits. For example, an alternative embodiment may have a closure plate 102 with two clamping systems as described herein. Other alternatives and variations will be apparent to persons of ordinary skill in the art in view of the present disclosure.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A window installation system for a portable air conditioner unit, the window installation system comprising:

a closure plate extending in a longitudinal direction between a first longitudinal end and a second longitudinal end, and in a transverse direction, perpendicular to the longitudinal direction, between a first transverse end and a second transverse end;

a vent opening extending through the closure plate between a first side of the closure plate and a second side of the closure plate, at a longitudinal location between the first longitudinal end and the second longitudinal end;

a clamp fixture located adjacent to the vent opening at the longitudinal location; and a clamp movably mounted to the clamp fixture and having a clamp surface facing the first side of the closure plate, wherein the clamp is movable relative to the clamp fixture between a first clamp position in which the clamp surface is a first distance from the first side of the closure plate in a depth direction that is perpendicular to the longitudinal direction and the transverse direction, and a second clamp position in which the clamp surface is a second distance from the first side of the closure plate in the depth direction, the second distance being less than the first distance wherein the clamp fixture has a first portion fixed to the closure plate and a second portion selectively mountable to the first portion at a plurality of different positions along the longitudinal direction, and wherein the clamp is movably mounted to the second portion.

2. The window installation system of claim 1, wherein the first transverse end is configured to seal against a window sash, and the second transverse end is configured to seal against a window frame.

3. The window installation system of claim 1, wherein the first longitudinal end is configured to seal against a first window frame rail, and the second longitudinal end is configured to seal against a second window frame rail facing the first window frame rail.

4. The window installation system of claim 1, wherein the window installation system does not include any additional clamp or clamps.

5. The window installation system of claim 1, wherein the clamp is movable along the clamp fixture on a linear path between the first clamp position and the second clamp position, the linear path extending parallel to the depth direction.

6. The window installation system of claim 1, wherein the first portion comprises a first fixed portion located along the transverse direction between the vent opening and the first transverse end of closure plate, and a second fixed portion located along the transverse direction between the vent opening and the second transverse end of the closure plate, wherein the second portion is selectively and alternately securable to one of the first fixed portion and the second fixed portion.

7. The window installation system of claim 1, wherein the first portion comprises a first rail member extending from the first side of the closure plate, and the second portion comprises a second rail member configured to slide on the first rail member.

8. The window installation system of claim 7, wherein the second rail member is configured to slide on the first rail member in a sliding direction parallel to the longitudinal direction.

9. The window installation system of claim 7, wherein one of the first rail member and the second rail member comprises an external T-track or L-track and the other of the first rail member and the second rail member comprises an internal T-track or L-track.

10. The window installation system of claim 1, wherein the first portion of the clamp fixture is integrally formed with the closure plate.

11. The window installation system of claim 10, wherein the clamp fixture comprises a passage extending into the first side of the closure plate.

12. The window installation system of claim 1, wherein the clamp and the clamp fixture comprise interlocking parts configured to hold the clamp at the second clamp position.

13. The window installation system of claim 12, wherein the interlocking parts comprise a one-way ratchet.

14. The window installation system of claim 13, wherein the interlocking parts comprise:

at least one first rib on the clamp, the at least one first rib extending perpendicular to the depth direction;

at least one second rib on the clamp fixture, the at least one second rib extending perpendicular to the depth direction; and wherein the at least one first rib and the at least one second rib are positioned to overlap with respect to the depth direction.

15. The window installation system of claim 14, wherein the at least one first rib is mounted to the clamp by a flexible arm configured to allow selective movement of the at least one first rib in a direction perpendicular to the depth direction to thereby disengage the at least one first rib from the at least one second rib.

16. The window installation system of claim 1, wherein the vent opening is configured to allow manual movement of the clamp from the first clamp position to the second clamp position, by a user reaching through the vent opening from the second side of the closure plate to the first side of the closure plate.

17. The window installation system of claim 1, further comprising a duct fitting extending from the closure plate at the vent opening and configured to connect with a hot air duct to form a continuous passage between the hot air duct and the vent opening.

18. The window installation system of claim 17, wherein the duct fitting extends from a non-circular end at the vent opening to a circular end spaced from the vent opening.

19. The window installation system of claim 18, wherein the non-circular end has a first geometric center axis along the depth direction and the circular end has a second geometric center axis along the depth direction, and the second geometric axis is offset from the first geometric axis along at least one of the longitudinal direction and the transverse direction.

20. The window installation system of claim 17, wherein the duct fitting extends from the first side of the closure plate.

21. The window installation system of claim 17, wherein the duct fitting extends from the second side of the closure plate.

22. The window installation system of claim 17, wherein the clamp fixture is selectively and alternatively securable to the closure plate with the duct fitting extending from the first side of the closure plate or the second side of the closure plate.

23. The window installation system of claim 1, wherein the longitudinal location is closer to the first longitudinal end than the second longitudinal end.

24. The window installation system of claim 1, wherein the closure plate comprises a first closure plate portion defining the first longitudinal end, and a second closure plate portion defining the second longitudinal end, wherein the second closure plate is telescopically mounted to move along the longitudinal direction relative to the first closure plate portion between a first configuration in which the first longitudinal end is spaced from the second longitudinal end by a first longitudinal distance, and a second configuration in which the first longitudinal end is spaced from the second longitudinal end by a second longitudinal distance, the second longitudinal distance being greater than the first longitudinal distance.

25. The window installation system of claim 24, wherein the vent opening is provided through the first closure plate portion.

* * * * *